US005156138A

United States Patent [19]

Grover

[11] Patent Number: 5,156,138

[45] Date of Patent: Oct. 20, 1992

[54] APPARATUS FOR DRAWING, HOLDING AND RELEASING BOWSTRING

[76] Inventor: Roger Grover, 1605 Treanor, Saginaw, Mich. 48601

[21] Appl. No.: 584,791

[22] Filed: Sep. 19, 1990

[51] Int. Cl.[5] ..... F41B 5/00

[52] U.S. Cl. ..... 124/35.2; 124/24.1; 124/88

[58] Field of Search ..... 124/35.2, 24.1, 35.1, 124/31, 88, 86, 23.1

[56] References Cited

U.S. PATENT DOCUMENTS

| | | | |
|---|---|---|---|
| 1,210,332 | 12/1916 | Kvistad | 124/35.2 |
| 2,664,078 | 12/1953 | Irwin | 124/35.2 X |
| 2,815,016 | 12/1957 | Kellogg | 124/35.2 |
| 2,982,279 | 5/1961 | Pursley | 124/35.1 |
| 3,446,200 | 5/1969 | Gross | 124/24.1 |
| 3,557,769 | 1/1971 | Hofmeister | 124/88 X |
| 3,561,418 | 2/1971 | Fredrickson | 124/35.2 X |
| 3,895,621 | 7/1975 | Kellogg | 124/35.1 X |
| 4,041,925 | 8/1977 | Barrick | 124/35.2 |
| 4,466,418 | 8/1984 | Jones | 124/35.2 |
| 4,603,676 | 8/1986 | Luoma | 124/35.2 X |
| 4,672,945 | 6/1987 | Carlton | 124/35.2 |

*Primary Examiner*—Peter M. Cuomo
*Attorney, Agent, or Firm*—John J. Swartz

[57] ABSTRACT

Apparatus for drawing a bow including a hand graspable bowstring gripping member for detachably gripping and rearwardly drawing the bowstring to flex the bow to a drawn condition and for releasing the bowstring to propel an arrow. The apparatus includes an elongate draw bar mounted on the hand graspable member and a guide member mountable on the bow for slidably receiving and guiding the draw bar for movement in a to-and-for reciprocal path of travel relative to the bow between inoperative position and a rearward bowstring drawing position. The apparatus includes a lock member for detachably holding the draw bar in the rearward bowstring drawing position including a stop member movable between a holding position forwardly of and in the path of the forward end of the draw bar when the draw bar is in the drawn position and a draw bar releasing position removed from the path of travel.

18 Claims, 2 Drawing Sheets

APPARATUS FOR DRAWING, HOLDING AND RELEASING BOWSTRING

BACKGROUND OF THE INVENTION

1. Field of the Invention

This invention relates to apparatus for drawing a bowstring, holding the bowstring in a drawn position and for releasing a bowstring to propel an arrow. More particularly, this invention relates to a new and novel lock for holding a bowstring draw bar in a rearward bow flexing position.

2. Description of the Prior Art and Objects:

The sport of archery has, over the years, become more refined and many different accessories have been provided to improve shooting accuracy. It has been found that consistency of draw will improve shooting accuracy. Shooters with different arm lengths have different draw lengths and thus require arrows of differing lengths. Accuracy is also affected by inconsistent releases of the bowstring. Sometimes this occurs through recoil or flinching. Accordingly, it is an object of the present invention to provide a new and novel bow draw apparatus which will reduce recoil or flinching that occurs when a bowstring is released to propel an arrow .

It is another object of the present invention to provide a bow draw system including a draw bar which is slidably reciprocally mounted on an archery bow and includes a draw stop which limits the length of the draw.

It is still another object of the present invention to provide bow draw apparatus of the type described including a draw bar mounting a trigger mechanism that detachably holds, in one position, the bowstring as the draw bar is normally drawn rearwardly and, in another position, releases the bowstring while the draw bar is manually held against the stop to minimize recoil.

One of the more serious factors which affects accuracy of the archer who is hunting is fatigue which builds if an archer is required to hold the bow in a drawn position for a substantial length of time. With the advent of so-called compound bows, fatigue is reduced, however, sometimes after an archer holds an arrow in a drawn position for a substantial length of time, his hand and arm muscles start to tremble thus affecting the flight of the arrow. Holding a drawn bow is particularly difficult for the physically handicapped. Accordingly, it is an object of the present invention to provide new and novel bow draw apparatus of the type described which includes new and novel lock mechanism for locking the bow in a drawn shooting position and allowing the archer the simplicity of just aiming and shooting without substantial muscle strain while holding the draw.

Yet another object of the present invention is to provide bow draw apparatus of the type described including a pivotal lock lever which is moveable from a position alongside the bow drawn rod to a position immediately in front of the bow draw rod when the bow draw rod is in the full rearward bow drawing position.

A further object of the present invention is to provide bow draw apparatus of the type described which includes a pivotal lock lever of the type described which is detachably mounted for immediate and quick removal.

A still further object of the present invention is to provide bow draw apparatus of the type described which will mount the arrow to be propelled on one side of the bow and a bow draw tube for mounting a bow draw bar on the opposite lateral side of the bow.

Other objects and advantages of the present invention will become apparent to those of ordinary skill in the art as the description thereof proceeds.

SUMMARY OF THE INVENTION

Apparatus for rearwardly drawing a taut bowstring spanning opposite ends of a flexible, hand-held, archery bow relative to said bow from a linear condition to a non-linear condition to flex the bow from an unflexed, undrawn condition to a flexed, drawn condition, detachably holding the bowstring in a non-linear condition and the flexed bow in a drawn condition, and releasing the bowstring and allowing the return of the archery bow to the undrawn condition to forwardly propel an archery arrow slidably received on the bow and detachably received at its rearward end by the bowstring, said apparatus comprising: hand graspable mechanism for detachably holding the bowstring and rearwardly moving the bowstring relative to the bow to flex the bow to the drawn condition and for releasing the bowstring to propel the arrow; a forwardly extending elongate draw bar mounted on the hand graspable mechanism; a guide mountable on the bow for slidably receiving and guiding the draw bar for movement in a to-and-fro reciprocal path of travel relative to the archery bow between a forward inoperative position and a rearward, bowstring drawn position; a lock for detachably holding the draw bar in the rearward bowstring drawing position including a stop moveable between a holding position forwardly of and in the path of the forward end of the draw bar when the draw bar is in the drawn position and a draw bar releasing position removed from the path of travel.

DESCRIPTION OF THE DRAWINGS

This invention may be more readily understood by referring to the accompanying drawings, in which.

DESCRIPTION OF THE PREFERRED EMBODIMENT

Figure 1:
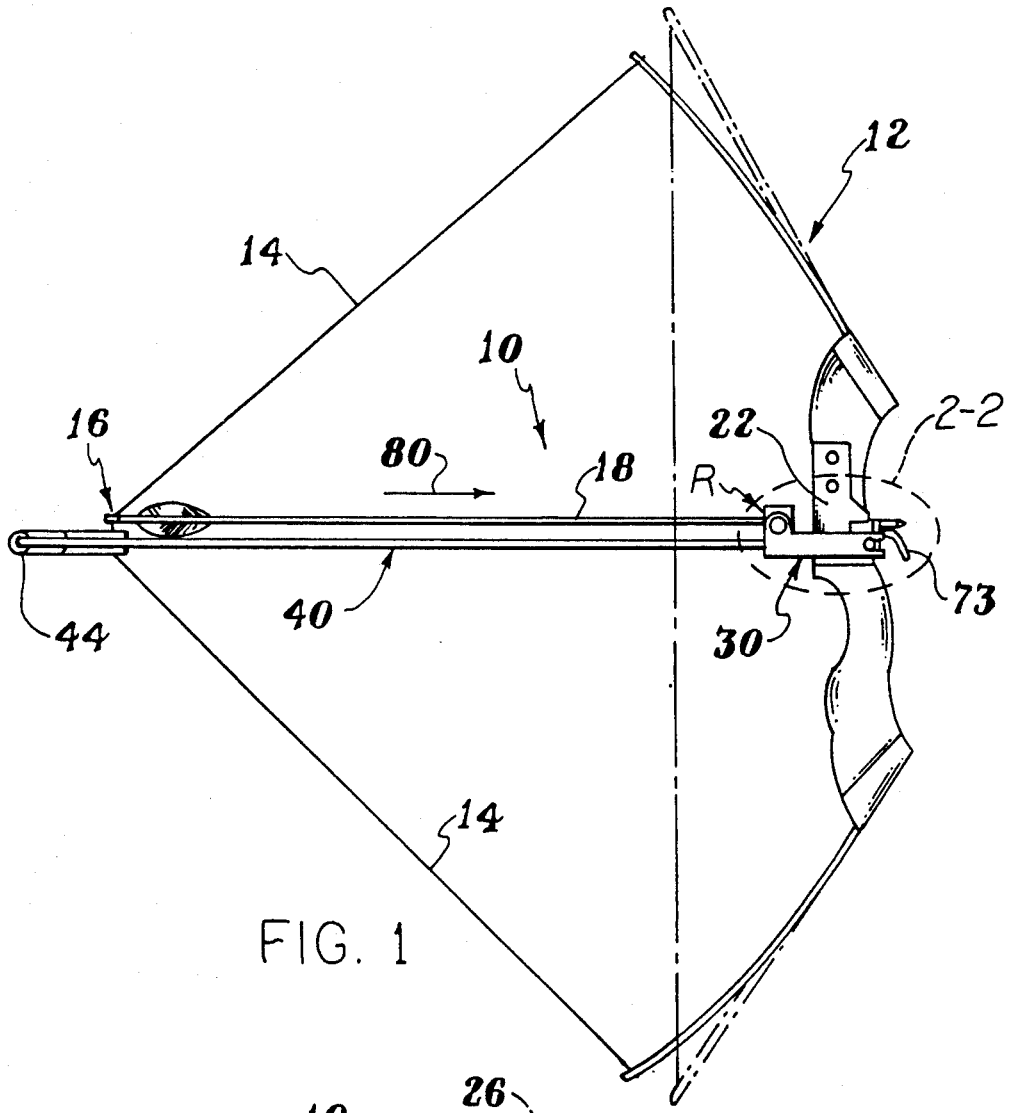
FIG. 1 is a side elevational view illustrating apparatus constructed according to the present invention mounted on an archery bow, illustrated in a bowstring drawing position, the rest position of the bow and bowstring being schematically illustrated in chain lines.

Apparatus constructed according to the present invention, generally designated 10, is particularly adapted for use on or in connection with a flexible, hand held archery bow, generally designated 12, which is flexible from an unflexed, undrawn position, schematically illustrated in chain lines in FIG. 1 to a flexed drawn condition, illustrated in solid lines in FIG. 1. The opposite ends of the bow 12 mount a taut bowstring, generally designated 14, for receiving the rearward normally grooved end 16 of a forwardly projecting arrow 18 having a longitudinal arrow shaft 17 mounting forward hardened tip 19 as usual. The string 14 is moveable from a linear position, illustrated in chain lines in FIG. 1, to a non-linear bow flexing, rearward position illustrated in solid lines in FIG. 1 by apparatus 10 constructed according to the present invention.

The apparatus 10 includes guide mechanism, generally designated 20, including a vertical mounting plate 22 which includes threaded receptacles 24 for receiving a threaded bolt 6 passing through openings 28 laterally through the bow 12. Mounted on the plate 22 at one lateral side of the bow 12 is a horizontally disposed guide tube, generally designated 30, including a hollow annular side wall 32 lined with a coating 34 of TEFLON TM material. The outer side 29 of the guide tube 30 remote from the bow 12 includes a forwardly opening, open ended slot 36 therethrough. The inner side 31 of tube 30 includes a second transverse slot 38 therethrough rearwardly of the forward terminal end 33 of tube 30 for purposes to be described hereinafter. An arrow rest R is mounted on the laterally opposite side of the bow 12 for slidably mounting the arrow 18.

The apparatus 10 includes a draw bar, generally designated 40, slidably reciprocally received by the tube 30, including a horizontally disposed laterally offset handle 44 having a trigger mounting end 45 disposed on the laterally opposite side of the bow 12.

Figure 10:
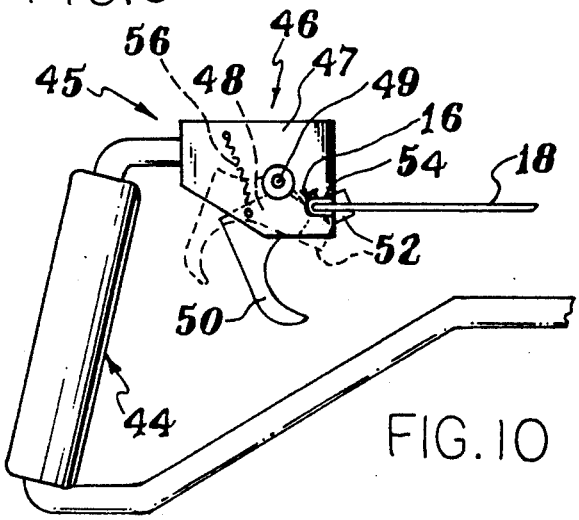
FIG. 10 is an enlarged framentary top plan view of the handle and trigger mechanism which holds and releases the bowstring.

The trigger mounting end 45 mounts a trigger housing 46 including a pair of vertically spaced plates 47 mounted on upper and lower sides of handle end 45. The plates 47 are spanned by a vertical pivot pin 49 which mounts a horizontally disposed trigger 48. The trigger 48 includes a finger graspable portion 50 on one side of pivot pin 49 and a bowstring gripping portion 52, on the opposite side of pin 49, which holds the bowstring 14 received in a forwardly opening, open ended vertically aligned slots 54 provided in the trigger housing plates 47. A spring 56 will urge the trigger 48 to the bowstring holding position, illustrated in solid lines in FIG. 10, but allowing the trigger 48 to move to the bowstring releasing position illustrated in chain lines in FIG. 10 to release the bowstring 14.

The laterally outer side 55 of draw rod 40 includes a plurality of predrilled and tapped holes 60 into which a stop screw 62 may be detachably threaded depending on the length of draw desired. When the user selects the draw, the balance 64 of the draw bar 40 forward of the stop screw may be severed. The stop screw 62 may also be removed for disassembly. When the draw bar 40 is moved to the rearward drawn position, the draw screw 62 is received by a forwardly opening, open ended draw slot 36 in the forward end of guide tube 30. When the draw screw 62 reaches the end 37 of slot 36 and bears against the tube 30, in its full rearward position, illustrated in solid lines in FIG. 2, the forwardmost end 66 of the remaining draw bar 40 will be disposed rearwardly of the cross slot 38 in tube 30.

To lock the draw bar in the rearward bowstring drawing position, a lock mechanism, generally designated 69, is provided and includes a pivotal mount block 70 fixed to tube 30. The mount block 70 pivotally mounts a horizontal shaft 72 having at its forward end an offset handle 73 and an intermediate stop lever or lock bar 74 that is normally aligned with the cross slot 38. The bar 74 is gravity held against the side of the draw bar 40 until the forward end 66 of the bar 40 moves rearwardly of slot 38 at which time the stop lever 74 will fall by gravity to a draw bar locking position, illustrated in solid lines in FIG. 4, in alignment with the front terminal end 66 of the draw bar 40.

Figure 4:
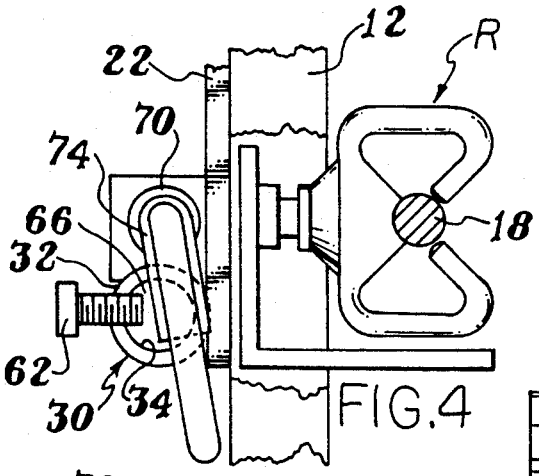
FIG. 4 is a front sectional view taken along the line 4—4 of FIG. 2.
Figure 5:
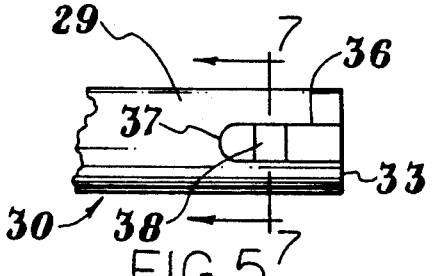
FIG. 5 is a side elevational view of the guide tube only, taken along the line 5—5 of FIG. 8.
Figure 6:
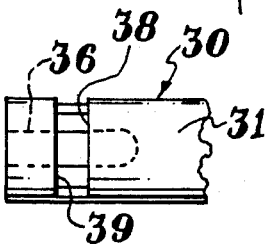
FIG. 6 is an enlarged opposite side elevational view of the guide tube only.

When the stop bar 74 moves to the draw bar locking position illustrated in FIG. 4, the draw bar 40 will not be permitted to move forwardly and the user can merely hold the bow in the drawn position endlessly without substantial effort until such time as a deer or other game comes into his view. The user need then merely aim the arrow, pull the trigger 50 to release the bow string 14 allowing it to be propelled forwardly to forwardly propel the arrow 18.

As is illustrated, the portion 41 of draw bar 40 which is received in the guide tube 30 is on one side of the bow and the terminal end portion 45 and the arrow 18 are on the laterally opposite side of the bow 12. With the stop lever 74 in the position illustrated in solid lines in FIG. 4, the bowstring 14 will exert forward force on the draw bar handle 44 in the direction of the arrow 80 which will exert pressure against the stop lever 74 which will in turn exert pressure against the down stream side 39 of cross slot 38.

The rotatable shaft or pin 72 is detachably held in the mount block 70 via a depressable spring loaded ball bearing detent 84 which can be depressed against the biasing force of the spring to allow the stop mounting shaft 72 to be easily and quickly axially outwardly removed. If the lever 74 was not bearing against the side 39 of slot 38, the force exerted on the lever 74 by the rod 20 in the drawn position would cause the shaft 72 to be moved forwardly to escape the mount block 70 and depress the lever 74 downwardly so that the entire lever 73 would move axially forwardly and the shaft 72 would be propelled out of the mount block 70. Because the lever 74 is received in the slot 38 and bears against wall 39, however, the lock mechanism 69 will remain in the position illustrated in FIG. 2.

THE OPERATION

The archer will mount the rearward arrow noch end 16 on the string 14 and support the arrow shaft 17 on the arrow rest R. The draw rod 40 is inserted into draw tube 30 and moved forwardly until the bowstring 14 is received by the slot 54 of trigger housing 46 with the trigger 48 held in the chain line position. The trigger 48 is then released so that the terminal end of bowstring gripper 52 prevents the bowstring 14 from escaping the slots 54 and holds the bowstring 14 in position. The stop screw 62 is threaded into the appropriate threaded recess 60 in the draw bar 40.

Figure 2:
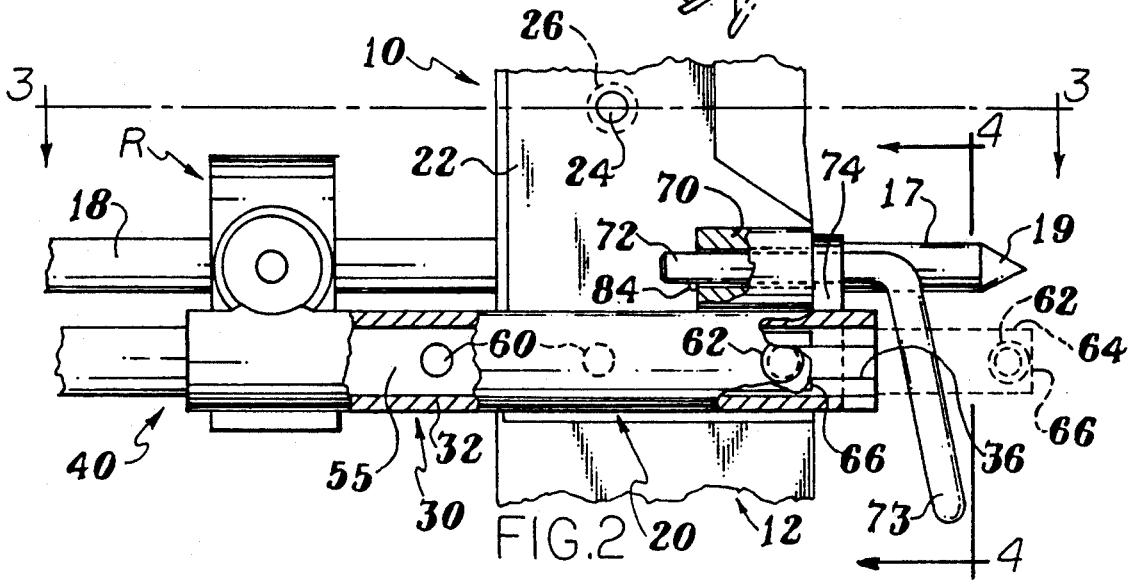
FIG. 2 is an enlarged side elevational view of the portion of the apparatus encircled in the chain line circle 2—2 of FIG. 1, parts of the apparatus being broken away in section to more clearly illustrate the draw bar and lock lever with a forward position of the draw rod being illustrated in chain lines.
Figure 3:
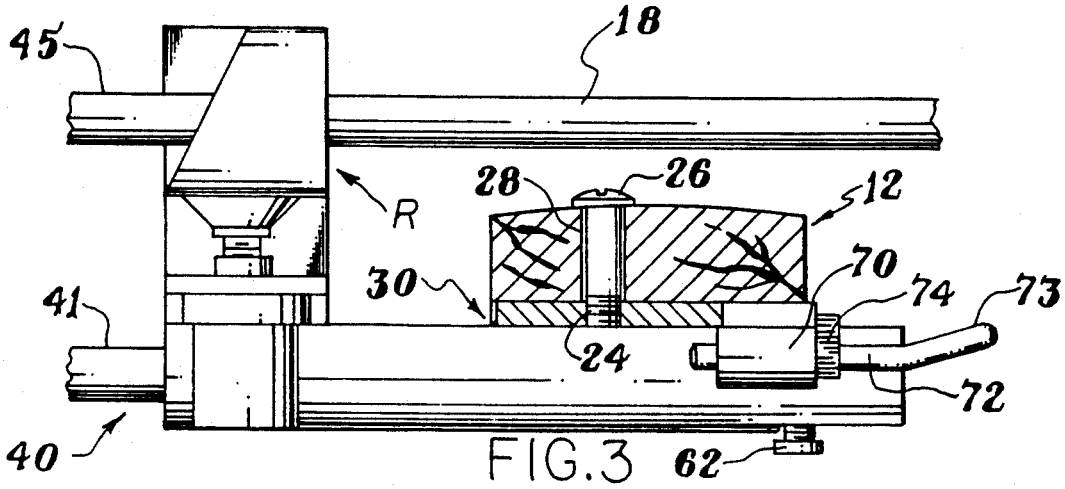
FIG. 3 is a sectional plan view, taken along the line 3—3 of FIG. 2, illustrating the apparatus constructed according to the present invention mounted on a bow in a drawn condition.

When the archer is ready to cock the bow, he rearwardly pulls on the handle 44 with one hand while holding the bow 12 with the other hand to rearwardly slide the draw rod 40 in guide tube 32 until the stop screw 62 reaches the inner end 37 of the slot 36, as illustrated in FIG. 2. This stop limits the length of draw and therefore, the archer holds the draw against the stop. When he releases the arrow by pulling on trigger 50, there will be no recoil or flinching because of the opposing forces exerted by the one hand holding the bow forwardly and the other hand pulling the draw bar 40 rearwardly against the end 37 of slot 36.

Figure 7:
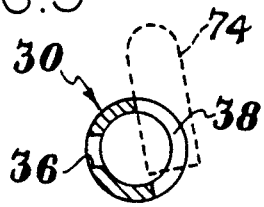
FIG. 7 is a front sectional view taken along the line 7—7 of FIG. 5.

If the archer desires, he can lock the draw bar 40 in the rearward bowstring drawing position by mounting the pivot shaft 72 in the mount block 70 and allowing the stop lever 74 to merely slide along the inner side of the bar 40. When the forward bar end 66 clears the cross slot 38 in tube 30, the bar 74 will swing, under gravity forces, downwardly to the position illustrated in chain lines in FIG. 7 and in alignment with the front end 66 of the bar 40 in FIG. 2.

Figure 8:
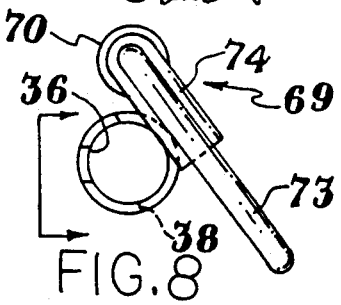
FIG. 8 is an enlarged front elevational view of the guide tube, draw bar, and draw bar lock mechanism when the draw bar is in the forward, rest position.
Figure 9:
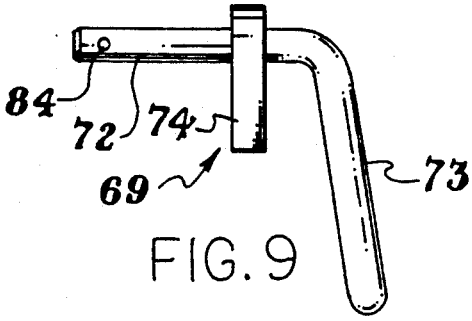
FIG. 9 is an enlarged top plan view of a pivotal lock lever for locking the draw bar.

The lock lever 74 holds the bow in the shooting position and gives the archer the simplicity of just aiming and shooting without muscle strain while holding the draw. To release the draw bar 40, the user need only manually grip the offset end 73 to move the draw stop lever 74 counter clockwisely, as illustrated in FIG. 4, to the position illustrated in FIG. 8.

It is to be understood that the drawings and descriptive matter are in all cases to be interpreted as merely illustrative of the principles of the invention, rather than as limiting the same in any way, since it is contemplated that various changes may be made in various elements to achieve like results without departing from the spirit of the invention or the scope of the appended claims.

What I claim is:

1. Apparatus for rearwardly drawing a taut bowstring spanning opposite ends of a flexible hand-held archery bow relative to said bow from a linear condition to a non-linear condition to flex the bow from an unflexed, undrawn condition to a flexed, drawn condition, detachably holding said bowstring in said non-linear condition and said flexed bow in said drawn condition, and releasing the bowstring and allowing the return of said archery bow to said undrawn condition to forwardly propel an archery arrow slidably received on the bow and detachably received at its rearward end by said bowstring comprising:

hand graspable means for detachably holding said bowstring and rearwardly moving the bowstring relative to said bow to flex said bow to said drawn condition and for releasing said bowstring to propel said arrow;

a forwardly extending elongate draw bar mounted on said hand graspable means, guide means mountable on said bow for slidably receiving and guiding said draw bar for movement in a to-and-fro reciprocal path of travel relative to said archery bow between a forward inoperative position and a rearward, bowstring drawing position; and lock means for detachably holding said draw bar in said rearward bowstring drawing position including stop means moveable between a holding position forwardly of and in the path of a forward end of said draw bar when said draw bar is in said drawing position and a draw bar releasing position removed from said path of travel;

said guide means comprising a hollow cylindrical cylinder having an annular side wall defining a bore receiving said draw bar;

said means for detachably holding said draw bar including a slot through said side wall;

said stop means comprising a lock bar swingably mounted for movement in said slot from said draw bar releasing position to said holding position in alignment with said forward end of said draw bar.

2. The apparatus set forth in claim 1 wherein said stop means further comprises a pivot pin, having an axis, mounting said lock bar for pivotal movement about said axis of said pivot pin; pivot pin mounting means detachably mounting said pivot pin for pivotal movement about said axis and for longitudinal movement to a removed position; and detent means for releasably holding said pivot pin in said pivot pin mounting means.

3. The apparatus set forth in claim 1 wherein said stop means is moveable from said releasing position to said holding position under the force of gravity.

4. The apparatus set forth in claim 3 wherein said lock bar normally resting on the side of said draw bar and falling, due to gravity, to a position in alignment with the forward end of said draw bar.

5. The apparatus set forth in claim 1 wherein said hollow cylindrical cylinder of said guide means slidably receives said draw bar; said draw bar includes stop means thereon for engaging a portion of said guide means to limit rearward movement of said draw bar relative to said guide means when said forward end of said draw bar is rearward of said stop means.

6. The apparatus set forth in claim 1 including arrow rest means for slidably mounting said arrow on said bow; means for mounting said guide means on one side of said bow; and means for mounting said arrow rest on the opposite side of said bow.

7. The apparatus set forth in claim 1 wherein said hand graspable means includes a horizontally offset handle having one end coupled to said draw bar and a horizontally offset terminal end; and trigger actuated means mounted on said horizontally offset terminal end for detachably holding said bowstring.

8. Apparatus for rearwardly drawing a taut bowstring spanning opposite ends of a flexible hand-held archery bow relative to said bow from a linear condition to a non-linear condition to flex the bow from an unflexed, undrawn condition to a flexed, drawn condition, detachably holding said bowstring in said non-linear condition and said flexed bow in said drawn condition, and releasing the bowstring and allowing the return of said archery bow to said undrawn condition to forwardly propel an archery arrow slidably received on the bow and detachably received at its rearward end by said bowstring comprising:

hand graspable means for detachably holding said bowstring and rearwardly moving the bowstring relative to said bow to flex said bow to said drawn condition and for releasing said bowstring to propel said arrow;

a forwardly extending elongate draw bar mounted on said hand graspable means;

guide means mountable on said bow for slidably receiving and guiding said draw bar for movement in a to-and-fro reciprocal path of travel relative to said archery bow between a forward inoperative position and a rearward, bowstring drawing position; and lock means for detachably holding said draw bar in said rearward bowstring drawing position including stop means moveable between a holding position forwardly of and in the path of a forward end of said draw bar when said draw bar is in said drawing position and a draw bar releasing position removed from said path of travel;

said guide means comprising a hollow annular side wall defining a bore said side wall being provided with a slot therethrough disposed between the opposite ends of said guide means;

said stop means comprising a lock bar member being received by said slot for pivotal movement from a position resting on said draw bar when said draw bar is in said forward inoperative position to said holding position in which said lock bar member is received by said bore and aligned with said forward end of said draw said bar when said draw bar is in said rearward bowstring drawing position to hold said draw bar in said rearward bowstring drawing position.

9. The apparatus set forth in claim 8 including draw stop means detachably mounted on said draw bar in any selected one of a plurality of different positions along the length of said draw bar.

10. The apparatus set forth in claim 9 including forwardly opening, open ended slot means in said side wall for receiving said draw stop means.

11. The apparatus set forth in claim 10 wherein said open ended means is of such length that said draw stop means will engage said side wall to preclude further rearward movement of said draw bar after said forward end of said draw bar has moved rearwardly of said means in said side wall.

12. The apparatus set forth in claim 11 including means for mounting said guide means on one side of said bow; and including arrow rest means, and means for mounting said arrow rest means on the other side of said bow.

13. The apparatus set forth in claim 12 wherein said hand graspable means includes a horizontally disposed handle attached to said draw bar on said one side of said bow and having an offset terminal end on the opposite side of said bow.

14. Apparatus for operating archery apparatus to forwardly propelling an arrow, said archery apparatus including a forwardly disposed, flexible, hand-held, curved-bow, having opposite ends, and being flexible from an unflexed, undrawn condition to a flexed drawn condition; and a rearwardly disposed taut bowstring spanning said opposite ends for receiving a rearward end of an arrow to be propelled forwardly of said bow;

said operating apparatus including means for rearwardly drawing said bowstring relative to said bow from a forward linear position to a rearward non-linear position to flex said bow from said undrawn condition to said drawn condition, holding the flexed bow in said drawn condition and said bowstring in said non-linear position, and releasing said bowstring to allow the return of said bow to said undrawn condition to forwardly propel said arrow comprising:

hand graspable means for detachably holding said bowstring and rearwardly moving said bowstring relative to said bow to flex said bow to said drawn condition and for releasing said bowstring to propel said arrow;

a forwardly extending elongate draw bar mounted on said hand graspable means for guiding the path of travel of said hand graspable means;

guide means mounted on said bow for slidably receiving and guiding said draw bar for movement in a to-and-fro reciprocal path of travel relative to said bow between a forward inoperative position and a rearward bow string drawing position;

stop means mounted on a forward portion of said draw bar;

said guide means including an open ended, forwardly opening slot for receiving said stop means to limit the rearward path of travel of said draw bar when said stop means travels the full extent of said slot;

said guide means comprising a hollow cylinder having a side wall defining an elongate passage receiving said draw bar; and including lock means for releasably locking said draw bar in said rearward bowstring drawing position including slot means in said side wall and a lock bar pivotally mounted for movement in said slot means between a position resting on the side of said draw bar when said draw bar is moving from said forward position to said rearward position and a position received in said passage in alignment with a forward end of said draw bar when said draw bar is in said rearward position.

15. The apparatus set forth in claim 14 wherein said draw bar includes means for detachably mounting said stop means in any selected one of a plurality of different longitudinally spaced positions along the length thereof.

16. The apparatus set forth in claim 14 wherein said hand graspable means is positioned to release said bowstring to propel said arrow on one lateral side of said bow and means is provided for mounting said guide means on the laterally opposite side of said bow.

17. The apparatus set forth in claim 14 wherein said forwardly opening slot includes a rearward end rearward of said slot means.

18. The apparatus set forth in claim 17 wherein said forwardly opening slot is provided in a portion of said side wall spaced from said slot means.

* * * * *